US005212848A

United States Patent [19]

Geyer

[11] Patent Number: 5,212,848

[45] Date of Patent: May 25, 1993

[54] SQUEEGEE BLADE

[75] Inventor: Robert A. Geyer, Champlin, Minn.

[73] Assignee: Tennant Company, Minneapolis, Minn.

[21] Appl. No.: 851,173

[22] Filed: Mar. 13, 1992

[51] Int. Cl.[5] ..... A47L 5/24

[52] U.S. Cl. ..... 15/401; 15/245; 15/402

[58] Field of Search ..... 15/245, 401, 402

[56] References Cited

U.S. PATENT DOCUMENTS 2,158,695 5/1939 Foss ..... 15/245
2,814,062 11/1957 Greisen ..... 15/245
4,817,233 4/1989 Waldhauser ..... 15/401 X

FOREIGN PATENT DOCUMENTS 1023394 3/1966 United Kingdom ..... 15/401

*Primary Examiner*—Chris K. Moore
*Attorney, Agent, or Firm*—Kinzer, Plyer, Dorn, McEachran & Jambor

[57] ABSTRACT

An improved flexible wiping blade for the vacuum pickup squeegee of a floor scrubbing machine. A series of small protuberances with spaces between them are provided at the lower edge of the blade on its surface that leads when the machine moves backward. At that time the reverse flexing of the blade moves the protuberances under the blade and they hold it off the floor, thus allowing any standing water on the floor to move under the squeegee. They do not interfere with normal flexing of the blade under normal down pressure, and they permit its wiping action to be free of streaks when the scrubbing machine moves forward.

7 Claims, 3 Drawing Sheets

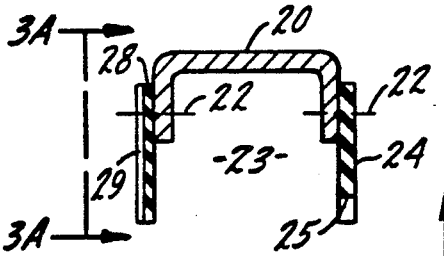
Fig. 3.
(PRIOR ART)
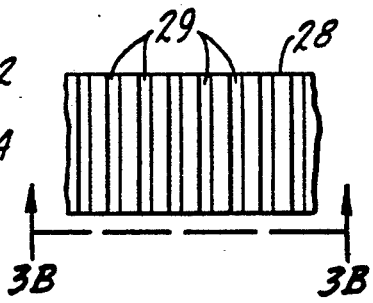
Fig. 3A.
(PRIOR ART)
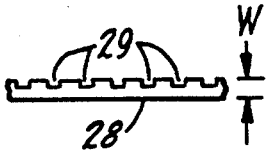
Fig. 3B.
(PRIOR ART)
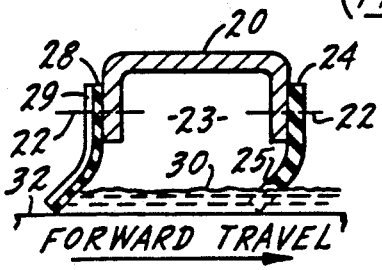
Fig. 3C.
(PRIOR ART)
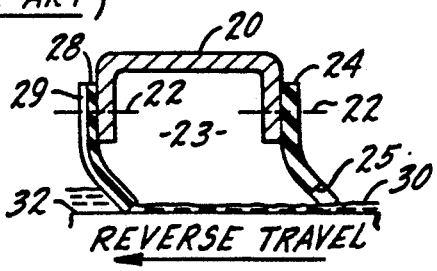
Fig. 3D.
(PRIOR ART)
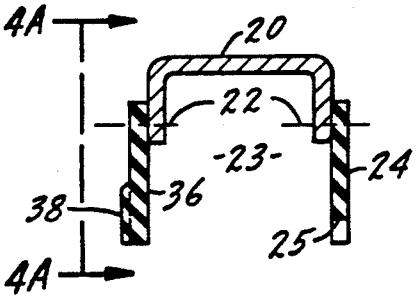
Fig. 4.
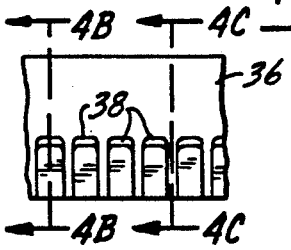
Fig. 4A.
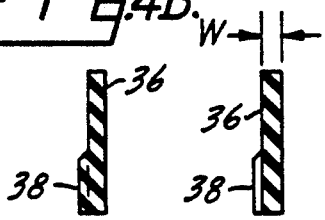
Fig. 4B.
Fig. 4C.
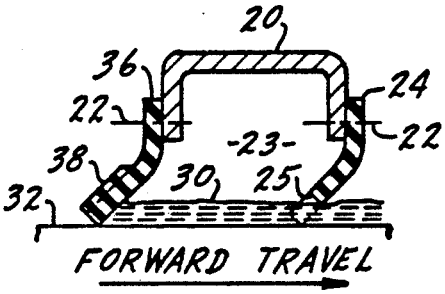
Fig. 4D.
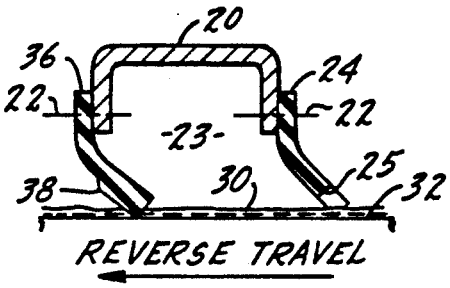
Fig. 4E.

SQUEEGEE BLADE

BACKGROUND OF THE INVENTION

Bare floors in commercial and industrial buildings are commonly cleaned with floor scrubbing machines. Such machines apply a scrubbing solution of water and detergent to the floor, agitate it with one or more rotating tools such as scrub brushes or pads to loosen soilage on the floor and suspend it in the solution, then pick up the soiled solution with a vacuum pickup squeegee located behind the brush or brushes.

The pickup squeegee is a critical part of such a floor scrubbing machine, and has been the object of extensive design development over the years. It extends transversely across the machine behind the brushes, and comprises a rigid squeegee frame having generally an inverted U-shaped cross section. Two rubber-like lips or blades are attached to this frame, one to each of its vertical legs, and extend down below the frame to the floor across the total width of the squeegee. An opening in the top center of the frame connects to a suction hose through which vacuum sucks soiled scrubbing solution from the space between the blades to a recovery tank. The entire assembly is attached to the machine with a hinged linkage that allows the squeegee blades to conform to irregularities in the floor surface and maintain a full contact with the floor.

As the machine travels in its normal forward direction, the forward squeegee blade meets the soiled scrubbing solution standing on the floor behind the brushes or other scrubbing tools. There are notches or other openings along the lower edge of this blade which allow the solution and some air to pass through the blade into the vacuumized space between the blades, from where it is sucked into the recovery tank. The rear squeegee blade is under enough down pressure to flex it back somewhat and give it a continuous contact along its length with the floor. It serves as a wiper lip to keep the scrubbing solution from escaping out of the squeegee chamber and to wipe the floor as dry as possible. Commonly this will be a damp dry condition which is dry enough so it is not slippery to walk on, and which will dry completely in a few minutes.

Common practice in floor scrubbing is to drive the machine the length of the area to be scrubbed, make a sharp 180 degree turn, drive back parallel to and slightly overlapping the first pass, and continue thus until the entire area is scrubbed. For the most part this procedure works well, but it also has a problem. As the machine is turned sharply at the end of each pass the squeegee moves in a largely sidewise direction, with the result that some of the soiled solution on the floor in front of the squeegee flows sidewise along the front surface of the front squeegee blade and escapes beyond the end of the squeegee which is on the inside of the turn. This leaves an unsightly and possibly hazardous puddle on the floor at each end of each pass.

The easiest way to control this is to make the turn, back up the scrubber across the resulting puddle until the puddle is in front of the squeegee, and then drive forward. The squeegee will pick up the puddle, and normal scrubbing can continue.

However, such a reverse direction maneuver puts additional demands on the squeegee. In forward travel the rear squeegee blade acts as a wiper, and for that purpose it has a continuous bottom edge. In reverse travel, however, this blade becomes the leading blade, and it should allow water to pass under it. But a blade with a continuous bottom edge will wipe water ahead of it in reverse as well as in forward travel, and not pass it through. So in some cases this blade has been modified to serve the function of passing water under it in reverse while still wiping cleanly in forward travel.

One common modification has been to make a series of vertical grooves in the trailing surface of the trailing lip. This construction has been used in a number of floor scrubbers and is shown, for example, in U.S. Pat. No. 4,817,233 (col. 4, li. 45–54). In reverse travel the flexing of the lip edge contacting the floor brings these grooves in contact with the floor, and water can pass through them to the interior cavity of the squeegee. The leading surface of the lip is left smooth, and the corner where the leading surface intersects the bottom surface remains as a contact line with the floor, to provide wiping action in forward travel.

In practice, however, there has been a problem. The bottom of each groove creates a thin section in the bottom surface of the squeegee blade, and these thin sections are not as stiff as the full thickness material between the grooves. Consequently, in forward travel these thinner sections do not press against the floor as firmly as the adjoining thicker sections. The result is that in forward travel these wiping squeegee blades leave a series of water streaks on the floor behind the squeegee corresponding to the grooves in the blade. These water streaks increase the hazard of a pedestrian slipping on the floor before it dries, and sometimes remain visible as dried muddy streaks after the floor dries. As might be expected, such shortcomings are objectionable to building managers where the equipment is used.

One effort at correcting this deficiency has been to make the squeegee blade thicker, so that the material at the bottoms of the grooves is as thick as a normal ungrooved blade. In this approach the space between the grooves also becomes thicker, so that in effect one has a normal thickness blade with a series of ribs on its back surface. These ribs act as stiffeners, and a blade made in this way does not flex as readily as a normal squeegee blade. But a squeegee blade must flex to be an effective wiper, so to get that flexing a greater than normal down force must be applied. This produces extra frictional force at the floor, which translates into harder pushing in a hand pushed machine, or higher power demand from the traction motor and batteries in a self propelled machine, with attendant reduced run time per battery charge. Also, the wear life of the squeegee blade is shortened. For these reasons this design has not been entirely satisfactory.

Because of the above shortcomings in prior art squeegee wiper blades there is an unfilled need for a squeegee blade that will flex without undue down pressure, will wipe cleanly without streaking in forward travel and will allow water to pass under or through it in reverse travel.

SUMMARY OF THE INVENTION

The present invention provides a novel squeegee blade which meets the above needs and avoids the shortcomings of the prior art. According to its teachings there is provided a squeegee blade which has a rectangular solid shape of normal length, width and thickness. Accordingly, when it is made of a suitable elastomeric or flexible plastic material, it exhibits an acceptable flexing characteristic when a normal down force is applied to it, and effective wiping action when used in a floor scrubbing machine. It also has the capability, when flexed in reverse, of providing space for water to pass under it. This is accomplished by providing a row of small protuberances or pads on one surface of the blade, which is the rear or following surface relative to the direction of travel when the blade is serving as a wiping blade on the rear leg of the pickup squeegee frame of a floor scrubbing machine. This row of pads is located at or near the edge which is closest to the floor when installed on a scrubbing machine. When viewed in this installed position, the pads are quite short in a vertical dimension. Commonly they extend up the surface of the blade less than half the distance from the lower edge to the stiff support of the squeegee frame. Thus they do not act as stiffening ribs, since the blade can and does flex normally above them without requiring excessive down force to do so. In forward operation the blade wipes the floor cleanly, with no tendency toward streaking, because it has a full normal thickness along its entire length apart from the pads, and so maintains adequate force against the floor all along its length. But the spaces between the pads allow water to pass through the blade when it is flexed in reverse operation.

BRIEF DESCRIPTION OF THE DRAWINGS

FIG. 3 shows schematically a section, similar to FIG. 2, through the pickup squeegee of the floor scrubbing machine of FIG. 1 wherein a squeegee blade of a second prior art design is used in conjunction with the prior art blade shown in FIG. 2B.

FIG. 3A is a view of the second prior art squeegee blade taken on view line 3A—3A of FIG. 3.

FIG. 3B is a view of the second prior art squeegee blade taken on view line 3B—3B of FIG. 3A.

FIGS. 3C and 3D show schematically the action of the prior art squeegee blades of FIGS. 2B and 3A on a floor having standing water on it when the scrubber of FIG. 1 is moving respectively in forward and reverse directions.

FIG. 4 shows schematically a section, similar to FIG. 2, through the pickup squeegee of the floor scrubbing machine of FIG. 1 wherein one squeegee blade made according to the present invention is used in conjunction with one prior art blade of the type shown in FIG. 2B.

FIG. 4A is a view of a squeegee blade made according to the present invention, the view being taken along view line 4A—4A of FIG. 4.

FIGS. 4B and 4C are sections through the blade of FIG. 4A, taken respectively along the section lines 4B—4B and 4C—4C of FIG. 4A.

FIGS. 4D and 4E show schematically the action of one blade made according to the present invention (as shown in FIGS. 4A, 4B and 4C) and one prior art blade (as shown in FIG. 2B) when used on a floor having standing water on it when the scrubber of FIG. 1 is moving respectively in forward and reverse directions.

DETAILED DESCRIPTION OF THE PREFERRED EMBODIMENT

Figure 1:
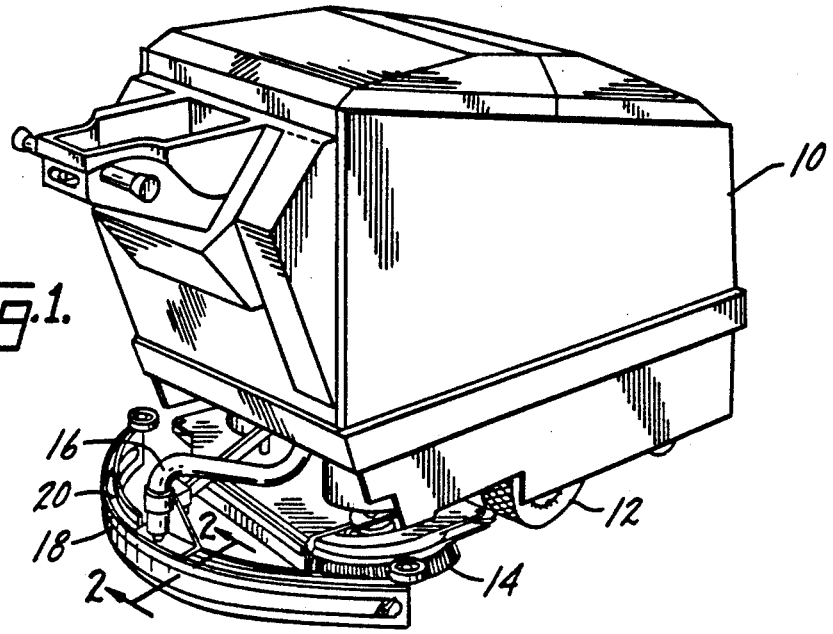
FIG. 1 shows a typical floor scrubbing machine on which the present invention can advantageously be used.

FIG. 1 shows a power floor scrubber which could advantageously be equipped with the present invention. This floor scrubber is entirely conventional. As shown it is a relatively small machine intended to be operated by a person walking behind it, and may be either hand pushed or self propelled. However, it could be a larger model designed for an operator riding on it. It has a body 10 supported by wheels, only one of which 12 is visible. A tank within the body contains a scrubbing solution of water and detergent which is spread on the floor under the machine. There are one or more scrub brushes 14 which are rotated by one or more electric motors to agitate the scrubbing solution and loosen dirt on the floor. The soiled scrubbing solution with its load of suspended dirt is then sucked up by vacuum and deposited in a recovery tank within the body for later recycling or disposal.

The vacuum pickup is done by a suction blower within the body, the blower being connected to a suction hose 16 which sucks soiled scrubbing solution and air from squeegee assembly 18. This squeegee assembly may be curved as shown in FIG. 1, or it may be straight; both styles are common. In any case it is comprised of a squeegee frame 20 to which the suction hose 16 is connected. The squeegee frame is connected to the scrubber with a hinged linkage that allows some articulation so the squeegee assembly can follow irregularities in the floor surface and conform to it. There is also a means, not shown, for applying a controllable down pressure as needed to the squeegee assembly.

An understanding of the invention requires an understanding of the prior art. Therefore some space will be devoted to describing how pickup squeegees on floor scrubbers are made and how they operate.

Figure 2:
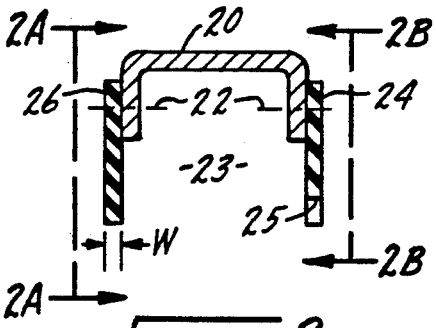
Fig. 2. (PRIOR ART)
FIG. 2 shows schematically a section 2—2 through the pickup squeegee of the floor scrubbing machine of FIG. 1 wherein squeegee blades of a first prior art design are used.

The squeegee frame 20 has a cross section like an inverted letter "U", with both the open legs pointing downward toward the floor. This is shown schematically in FIG. 2 and other drawings. There is a flexible strip of rubber-like or plastic material called a squeegee lip or blade attached to each of the depending legs of the squeegee frame. Attachment of the blades to the frame may be by any conventional method, indicated schematically in FIG. 2 and other drawings by two center lines which are numbered 22 in FIG. 2. In any event, the attachment means will be such that none of the stiff parts extend substantially below the lower edge of the squeegee frame. This is so the part of the squeegee blades below the frame can flex freely when the squeegee assembly is pulled across the floor by the scrubber.

Figure 2A:
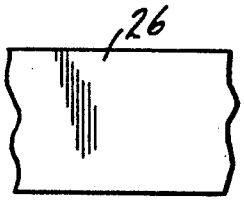
Fig. 2A. (PRIOR ART)
FIGS. 2A and 2B are views of the prior art squeegee blades of FIG. 2 taken respectively on view lines 2A—2A and 2B—2B of FIG. 2.
Figure 2B:
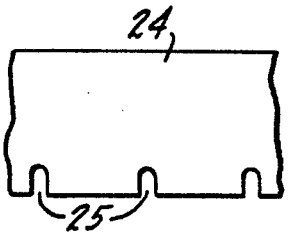
Fig. 2B. (PRIOR ART)

The two blades of a pickup squeegee serve different purposes. The leading blade, relative to the travel direction of the scrubber, provides a seal for the pickup chamber 23, which is the space under the squeegee frame and between the two blades, so it can be evacuated. However, this blade must not provide a 100 percent seal because it must also admit soiled scrubbing solution from in front of the squeegee into the pickup chamber 23. To this end several blade designs are used. A common one designated 24 is best shown in FIG. 2B. The lower edge of the blade, nearest the floor, has a series of notches 25 along it. These are sized and spaced to permit adequate inflow of scrub solution and enough air to entrain the liquid so it can be sucked into a recovery tank.

The trailing blade, relative to the travel direction of the scrubber, completes the sealing of the pickup chamber 23 and retains water in the pickup chamber until it can be evacuated. Most importantly, however, it wipes the floor to a damp dry condition. This should be dry enough so there is no risk of a pedestrian slipping or falling on it, and so that it will dry completely in a few minutes. These functions are commonly met with a simple rectangular solid blade such as 26, of thickness W, made of suitable elastomeric or flexible plastic material, and best shown in FIGS. 2 and 2A.

Figure 2C:
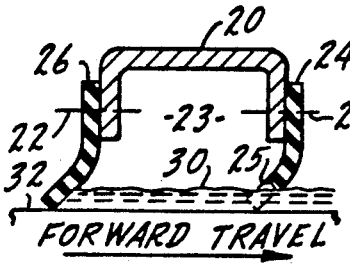
Fig. 2C. (PRIOR ART)
FIGS. 2C and 2D show schematically the action of the squeegee blades of FIGS. 2A and 2B on floor having standing water on it when the scrubber of FIG. 1 is moving in forward and reverse directions.
Figure 2D:
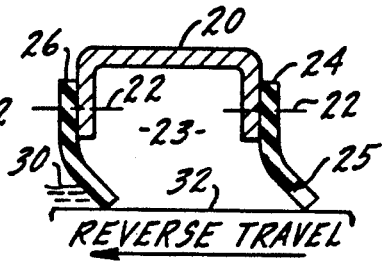
Fig. 2D. (PRIOR ART)

The action of a squeegee equipped with a front blade such as 24 and a rear blade such as 26 is shown schematically in FIGS. 2C and 2D. FIG. 2C shows the condition when the scrubber is moving forward. Water 30 standing on the floor 32 passes through the notches 25 in the lower edge of front blade 24, into the evacuated pickup chamber 23 under squeegee frame 20 and between blades 24 and 26. From there it will be sucked up into suction hose 20 and carried to a recovery tank. Enough down pressure is exerted on the squeegee assembly that rear blade 26 in FIG. 2C is flexed to the rear, pressing a corner all along its lower edge firmly against the floor. This retains the water in the pickup chamber 23 and wipes the floor to a damp dry condition. Forward blade 24 may also be flexed to some degree as shown, or it may be dimensioned to just clear the floor and operated without flexing.

FIG. 2D shows the operation of this combination of prior art blades when the machine is operating in reverse travel. Then blade 26 becomes the leading blade, and due to its solid construction it does not allow any water to get into the pickup chamber. Blade 24 has no function in this case. Thus this combination of blades will prevent water from entering or passing through the squeegee in reverse. As explained earlier, on occasion it is desirable to be able to back up across a puddle of standing water until the puddle is in front of the squeegee, so this combination of blades has a significant shortcoming. Yet blades like these are found on many scrubber squeegees.

FIG. 3 shows a squeegee in which the same front blade 24 is combined with a different type of prior art rear blade 28, made as shown in FIGS. 3A and 3B. Blade 28 has a thickness W as shown in FIG. 3B which is the same as the thickness W of blade 26 in FIG. 2. However, blade 28 has a series of grooves 29 molded into one of its side surfaces, as shown in FIG. 3A and perhaps most clearly in FIG. 3B. This blade is installed with the grooves to the left, as viewed in FIG. 3.

The action of this combination of blades is shown in FIGS. 3C and 3D. The design intent is that in forward travel, shown in FIG. 3C, they should work the same as the combination shown in FIG. 2C. That is, the ungrooved side of blade 28 presented to the water should seal it and wipe it in the same way as blade 26 does. In reverse travel, as shown in FIG. 3D, blade 28 becomes the leading blade and flexes so that the grooves 29 are next to the floor and water can pass through them into the pickup chamber 23. A portion of the water will be vacuumed up, and a portion will pass through the notches 25 in blade 24. If the machine is being backed up across a puddle, this water will be in front of the squeegee when the machine is again started in forward travel, and will be picked up then. This combination of prior art blades 24 and 28 thus addresses the problem of wiping and retaining water when traveling forward while permitting passage of water under the squeegee when traveling in reverse. It is the best arrangement for satisfying the requirements of forward and reverse squeegeeing that has been offered by the prior art, but it still has a shortcoming.

Figure 6:
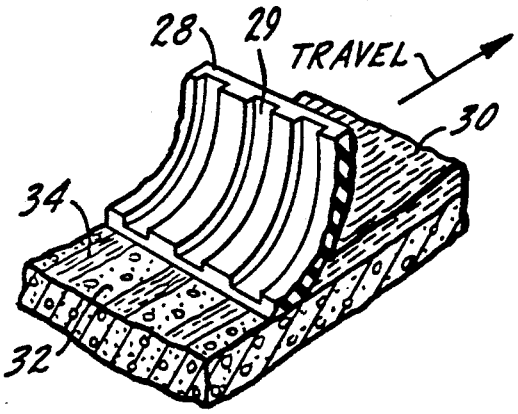
Fig. 6. (PRIOR ART)
FIG. 6 is a perspective view of the prior art blade of FIGS. 3A and 3B in use.

As can be seen in FIG. 3B, blade 28 has a normal thickness W, but is much thinner at the bottom of each groove 29 than it is between them. As mentioned earlier in the "Background of the Invention", there is a problem with this type of construction. We refer the reader to that discussion. Briefly, the thinner material in the bottoms of the grooves 29 is not as stiff as the thicker material between the grooves. Therefore, in forward travel the blade does not press against the floor as firmly in the grooves as it does in the adjoining thicker sections. The result is that an undesirable streak of water as seen at 34 in FIG. 6 is left on the floor behind each groove. And if the blade is made thicker to overcome this shortcoming it becomes stiffer and requires extra down force to make it flex, as was described in the "Background of the Invention."

Figure 7:
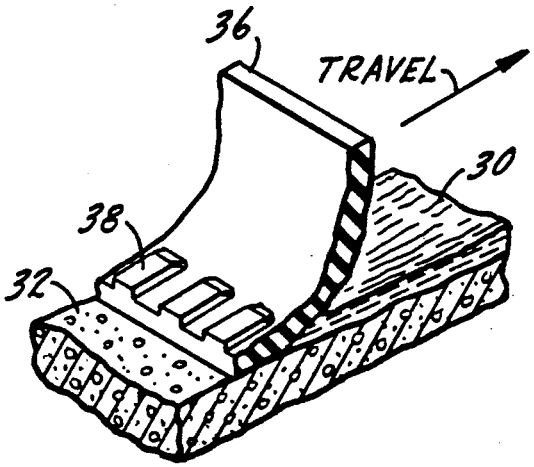
FIG. 7 is a perspective view of the squeegee blade of the present invention in use.

A solution to the problem is to equip the squeegee with a blade 36 made according to the present invention, as shown in FIG. 4. Blade 36 as seen in FIG. 4C has a basic thickness W, which is the same thickness as blade 26. Therefore, when made of suitable elastomeric or flexible plastic material, blade 36 will flex properly under normal down pressure, requiring no more down pressure for a given flexing than blade 26. Also, blade 36 does not have any thin sections like those in the bottoms of grooves 29 of blade 28. Therefore it exerts even pressure along its length on the floor 32, with the result that it wipes evenly and leaves the floor behind it in a uniform damp dry condition, without any water streaks. This is shown in FIG. 7.

Blade 36 also has the ability to allow water to pass under it when it is flexed in reverse travel. This is because of a row of protuberances or pads 38, best shown in FIGS. 4A, 4B and 4C, which are integrally molded or otherwise attached to one side surface adjacent to one edge of the blade. These protuberances and their action were described in "Summary of the Invention". The reader is referred to that discussion.

Blade 36 can be paired with a blade 24, as shown in FIG. 4. The action of such an arrangement in forward and reverse travel is shown in FIGS. 4D and 4E. It will be seen that in forward travel (FIG. 4D) blade 24 admits water to the pickup chamber 23, and that blade 36 seals it there for pickup and wipes the floor cleanly behind the squeegee. In reverse travel, shown in FIG. 4E, water passes under blade 36 through the spaces between the protuberances 38, and at least some of that water also passes out of the pickup chamber 23 through the notches 25 in blade 24. This action is similar to that shown in FIG. 3D.

Figure 5:
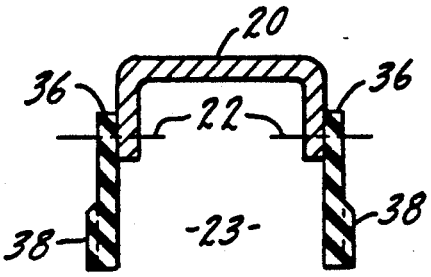
FIG. 5 shows schematically a section, similar to FIG. 2, through the pickup squeegee of the floor scrubbing machine of FIG. 1 wherein two blades made according to the present invention are used.
Figure 5A:
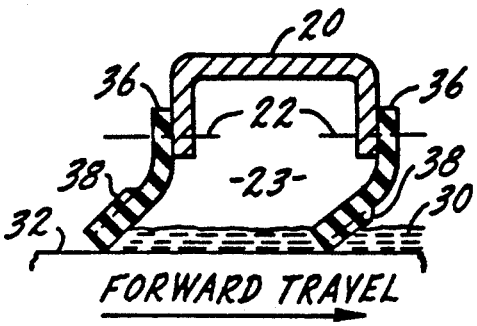
FIGS. 5A and 5B show schematically the action of a vacuum pickup squeegee equipped with two squeegee blades made according to the present invention on a floor having standing water on it when the scrubber of FIG. 1 is moving respectively in forward and reverse directions.
Figure 5B:
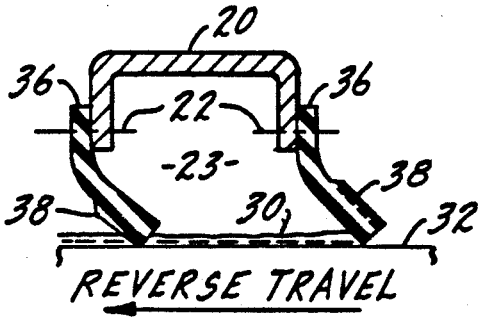

Under some conditions it might be desired to not let any water pass out of the pickup chamber 23 in either forward or reverse travel. This can be done by equipping the squeegee with two of the new style blades 36, as shown in FIG. 5. Note that both blades are installed with their protuberances 38 facing away from the pickup chamber. The action in forward and reverse is then as shown in FIGS. 5A and 5B respectively. In either case the leading blade admits water to the pickup chamber and the trailing blade seals it there and wipes the floor cleanly.

It will be recognized by one skilled in the art that variations from the described construction are readily possible. Thus, for example, the thickness of the blade above the pads could be varied to be more or less than the thickness between the pads, or the blade apart from the pads could have a tapered cross section, if one wished to tailor a squeegee blade to some particular flexural stiffness, or for any other reason. Also, the pads could have any of various shapes such as, for example, round, square, oval, etc. Any variations would still be within the purview of the invention so long as three requirements are met. First, the pads must be kept short enough so the blade can readily flex above them. Second, the spaces between the pads must be kept thick enough to support a uniform wiping lip along the blade edge in front of the pads in forward travel, with the wiping lip exerting essentially the same pressure against the floor in front of the spaces as it does in front of the pads. And third, the spaces between the pads must provide passages for water to pass through when the blade is flexed backward in reverse travel.

I claim:

1. A flexible squeegee blade having a generally rectangular solid shape with a length, a width which is less than the length, and a thickness which is less than the width, said blade having first and second opposed side surfaces with dimensions equal to the length and width of the blade, and at least one edge surface with dimensions equal to the length and thickness of the blade, intersections between the first and second side surfaces and the one edge surface, the second side surface having a series of protuberances along its length with non-protruding spaces between them, said protuberances extending from adjacent the edge of the second side surface where said second side surface intersects said one edge surface and extending in the width direction of the second side surface for a distance which is less than the width of the squeegee blade.

2. The flexible squeegee blade of claim 1 in which the protuberances extend in the width direction of the second side surface for a distance which is less than half the width of the squeegee blade.

3. The flexible squeegee blade of claim 1 in which the protuberances are an integral molded part of the squeegee blade.

4. A vacuum squeegee for a floor scrubbing machine including a frame and a pair of spaced flexible squeegee blades attached to said frame and defining a pickup chamber therebetween, each blade being generally rectangular and having a length, width and thickness, each blade having a lower floor contacting edge, each blade having an interior surface facing the pickup chamber and an exterior surface facing away from the pickup chamber, the exterior surface of at least one of said blades having a plurality of spaced protuberances thereon providing selective thickened areas adjacent the floor contacting edge, each of said protuberances extending in a direction away from the floor contacting edge for a distance which is less than the width of the blade, gaps between said spaced protuberances, with the thickness of the blade at the gaps being equal to blade thickness, said floor contacting edge forming a seal with a floor when said vacuum squeegee moves in one direction, and permitting water to flow through said gaps when the vacuum squeegee moves in the opposite direction.

5. The vacuum squeegee of claim 4 further characterized in that the exterior surface of each of said flexible squeegee blades has a plurality of spaced protuberances thereon providing selected thickened areas adjacent the floor contacting edge, and gaps between said spaced protuberances, with the thickness of the blade at the gaps being equal to blade thickness.

6. The vacuum squeegee of claim 4 further characterized in that each of said protuberances extends in a direction away from the edge surface for a distance which is less than half the width of the squeegee blade.

7. A flexible squeegee blade for use on a floor scrubbing machine, said squeegee blade having a lower floor contacting edge which wipes uniformly along its length against a floor, a series of pads on the squeegee blade adjacent the floor contacting edge, said pads being local in nature so as not to interfere with the normal flexing action of the blade and with the uniform wiping action of the blade along the length of its floor contacting edge against the floor, said pads extending in the width direction of the blade from the floor contacting edge a distance that is less than the width of the blade and spaces between the pads through which water can pass when the blade is flexed backward during reverse travel of the scrubbing machine.

* * * * *